US012655617B2

(12) United States Patent
Edwards

(10) Patent No.: US 12,655,617 B2
(45) Date of Patent: Jun. 16, 2026

(54) SMART FILL SYSTEM

(71) Applicant: Kenneth Edwards, Broussard, LA (US)

(72) Inventor: Kenneth Edwards, Broussard, LA (US)

( * ) Notice: Subject to any disclaimer, the term of this patent is extended or adjusted under 35 U.S.C. 154(b) by 161 days.

(21) Appl. No.: 18/604,409

(22) Filed: Mar. 13, 2024

(65) Prior Publication Data

US 2024/0309618 A1 Sep. 19, 2024

Related U.S. Application Data

(60) Provisional application No. 63/489,804, filed on Mar. 13, 2023.

(51) Int. Cl.
*E03C 1/04* (2006.01)
*E03C 1/05* (2006.01)

(52) U.S. Cl.
CPC ..... *E03C 1/04* (2013.01); *E03C 1/055* (2013.01); *E03C 2001/0418* (2013.01)

(58) Field of Classification Search
CPC ..... E03C 2001/0418; E03C 1/055; E03C 1/04
USPC ..... 4/668
See application file for complete search history.

(56) References Cited

U.S. PATENT DOCUMENTS

2002/0136223 A1* 9/2002 Ho ..... H04L 45/502 370/395.51
2005/0072850 A1* 4/2005 Cornwall ..... E03C 1/055 236/DIG. 8
2010/0263742 A1* 10/2010 Bogdanska ..... E03C 1/055 137/389
2021/0388584 A1* 12/2021 Thomas ..... F16K 31/041

* cited by examiner

*Primary Examiner* — Lauren A Crane
(74) *Attorney, Agent, or Firm* — Law Office of Jeff Williams PLLC; J. Oliver Williams

(57) ABSTRACT

A smart fill system includes one or more modules in connection with one or more water lines for regulating the temperature and flow rate of water into a vessel. The modules include a solenoid configured to regulate water flow through the module. A display is used to inform a user of information such as temperature of the water, flow rate, and fill level. A sensor is in electrical communication with the modules and is configured to detect the combined temperature of the water released from the modules. The sensor is configured to detect the water level and the module may automatically shut off the water at a predetermined water fill depth. A remote electronic device may be used to permit wireless control of the module.

11 Claims, 2 Drawing Sheets

SMART FILL SYSTEM

CROSS REFERENCE TO RELATED APPLICATIONS

This application claims the benefit of an earlier filing date and right of priority to U.S. Provisional Application No. 63/489,804, filed 13 Mar. 2023, the contents of which is incorporated by reference herein in its entirety.

BACKGROUND OF THE INVENTION

1. Field of the Invention

The present application relates to a water control system, and more particularly to a system used to regulate both temperature and flow rate of water entering a vessel.

2. Description of Related Art

Early baths were built of wood and required manual filling. When they weren't in use, they were normally stored. The first permanently fixed bathtubs were made of wood and lined with metal such as tin, copper, or iron. In 1883, John Kohler covered it with white enamel. Today, most homes in the United States have more than one bathroom, and bathrooms have become status symbols. Our contemporary bathtubs are made from a range of materials, colors, tiles, and alternatives. Today, however, bath trends appear to be returning to the original beauty of the pure white, sumptuous soaking tub that provides a minimalistic backdrop for relaxation, romance, and regeneration.

When drawing a bath, you must always test the water temperature by making skin contact with it. This method of testing frequently requires many attempts and may result in too hot or too cold water. To avoid overflowing the tub, filling it with water involves regular attention to the water flow and fill rate. Most tubs feature an overflow mechanism. However, if the incoming flow of water exceeds the capacity of the overflow drain, spillage is unavoidable if not carefully controlled. Overflow drains are often smaller than main drains and are unable to manage the whole flow of water. Overflowing tubs can have disastrous consequences. Forgetting that a tub is filling or becoming preoccupied during the process frequently results in a huge amount of water on the floor of the bathroom or the room in which the tub is placed. Depending on how long water has been allowed to overflow, the damage can be serious and costly.

Although strides have been made, shortcomings remain. It is desired that an assembly be provided that provides a user with total control over the flow, temperature, and water level while filling a bathtub by automatically regulating temperature control and flow control over hot and cold waters.

BRIEF SUMMARY OF THE INVENTION

It is an object of the present application to provide a system configured to regulate the dispersion of hot and cold waters into a bath. The system is configured to communicate with both hot and cold water supply lines in either a dual unit or single unit configuration depending on the style of fixtures. The system is configured to utilize wireless technologies to allow remote operation and control of the unit.

It is an object of the present invention to allow the user to operate and fill the tub remotely with a software application via a remote electronic device, or conversely at a particular unit. The sensors incorporated into the system prevent overflow while adjusting the temperature and flow velocity of the water to the user's prescribed levels. It is easily installed into existing fixtures or in new construction.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
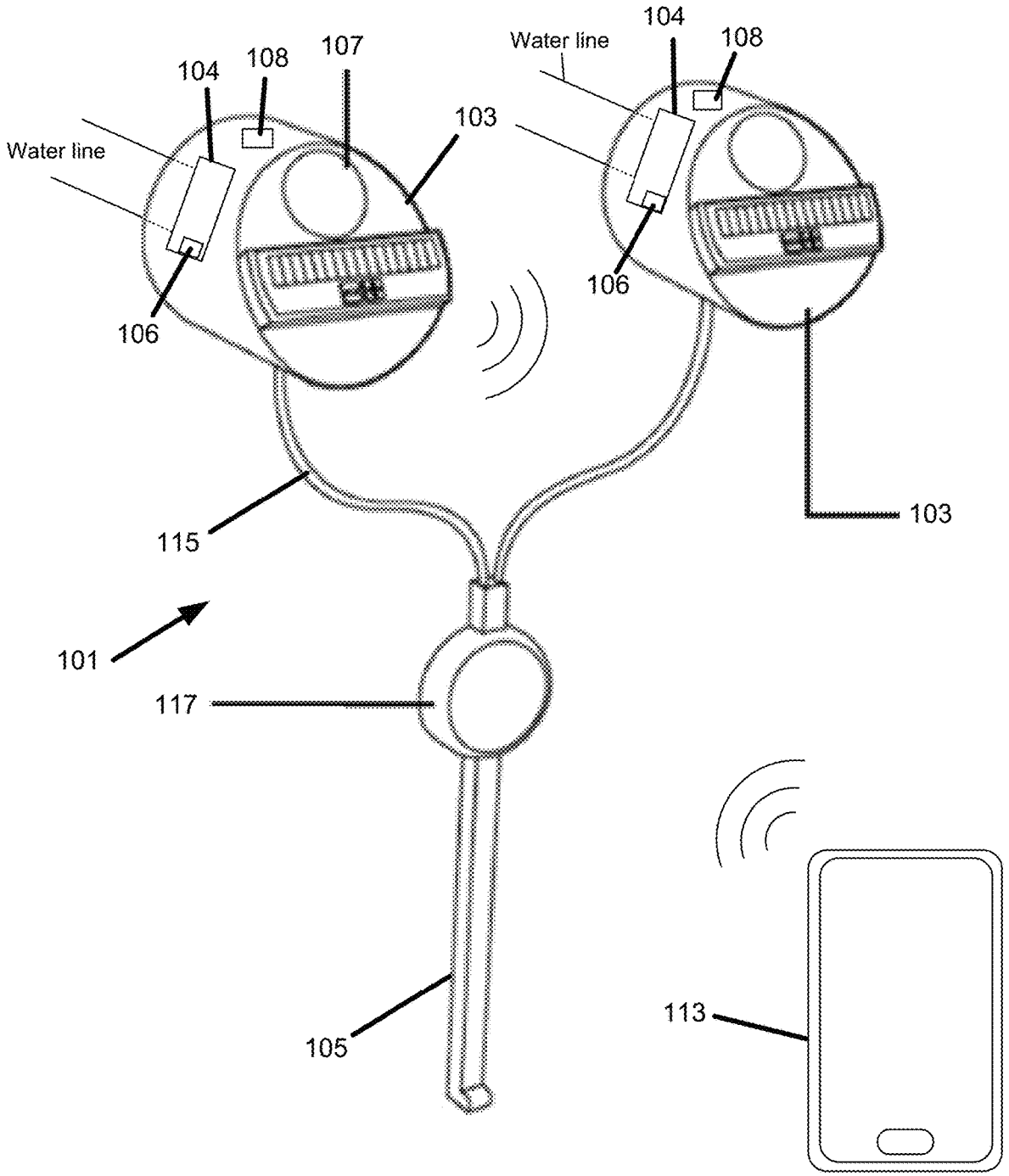
FIG. 1 is a perspective view of a smart fill water system according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with the prior art discussed previously. In particular, the smart fill system is configured to regulate the temperature and flow rate of water into a bath fixture. The system is configured to utilize wireless technologies to enable remote operation and control for a user. The system further includes the capability to auto shut off and regulate the fill level of water within the bath fixture. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

The smart fill water system of the present application is configured to provide a user with automatic monitoring and temperature control of the water used to fill a vessel, such as a bath. The system is a clever and innovative device that employs modern technology to provide the user with total control over the flow, temperature, and water level while filling a bathtub. The system is operable with either a single unit or a dual unit configuration as seen in the figures.

The system is made up of at least one control unit/module that fits on the supply line for the water, or may serve as the control valve of either the hot and/or cold valves used to control the flow of water into the tub/vessel. The modules can manage the flow of water and keep the temperature mix under control. The modules are a collection of solenoids that regulate and modify the flow of water. A sensor device is installed beneath the waterspout in the tub. The sensor sends data to the solenoids in the module. The sensor is adjustable for tub depth and sends data to the module solenoids about water temperature and depth. To allow the tub overflow drain to work correctly, the sensor tube includes it.

Figure 2:
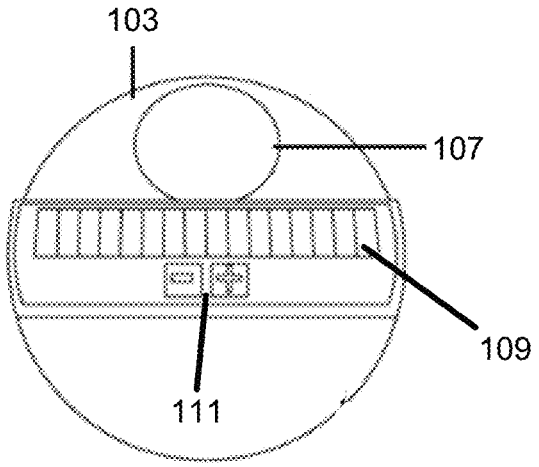
FIG. 2 is a front view of a control module used in the smart fill water system of FIG. 1.
Figure 3:
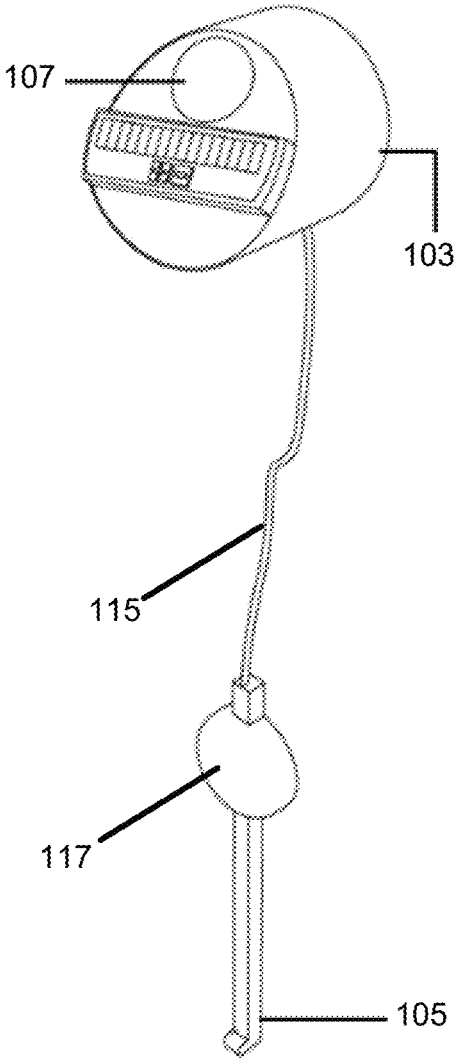
FIG. 3 is a perspective view of the smart fill water system of FIG. 1 using a singular control module.

Referring now to FIGS. 1-3 in the drawings, views of the smart fill water system 101 is illustrated. System 101 includes at least one control module 103 and a sensor 105 (sensing element). Control module 103 is configured to couple to the water supply lines or water valves that are used to provide a flow of water into a vessel. For purposes herein, the word "vessel" shall refer to a bathtub but it is understood that many other vessels are possible and this usage should not be limiting. Control module 103 is an electronically controlled unit that provides operative control over the temperature of water collected in a vessel and over the flow rate of water passing through the water line.

Module 103 may include one or more valves and or solenoids 104 configured to open and close to permit the selective passage of water. Control module 103 may regulate the flow of water from shutting it off to allowing it full flow. Module 103 further includes a module sensor 106 capable to detect the temperature of the water passing through the supply line/module 103. Additionally, each module 103 includes a control unit 108 in communication with sensor 106 and solenoid 104. Where multiple modules 103 are used, one module may be designated as "master" over the other. The modules may communicate via control units 108. The "master" module may regulate the actions of the other ("servant") module.

Sensor 105 is inserted into the vessel in communication with the water collected in the vessel, in this case below the waterspout. The sensor 105 is used to convey and/or receive data with the control module 103, i.e. module solenoids. The sensor 105 is adjustable in its location within the vessel, such as to regulate for tub depth. Sensor 105 is configured to transmit information on overall water temperature and water depth in the vessel back to the control module 103. Sensor wires 115 are used to electrically transport or carry data between control modules 103 and sensor 105. The data is transmitted from the sensor to the solenoids 104 in the modules 103 via a sensor wire 115.

The sensor 105 and its housing incorporates the tub overflow cover 117. Cover 117 may be used to cover over the overflow port in the vessel (i.e. tub). This may be used optionally based upon the design of the vessel. It is understood that the appearance or form of sensor 105 is not herein limited to that shown in the figures.

In embodiments with dual modules 103, the solenoids of modules 103 communicate with each other to correctly determine the preset water temperature and depth. The "master" module may adjust the flow rate of water in either water line to affect the temperature of the collected water in the vessel.

As seen in the Figures control module 103 includes a display 107, a graphical interface 109, and a user input interface 111. Display 107 is configured to provide a temperature readout in as a unit measurement, such as in Fahrenheit or Celsius. This may be provided through an easily read display at the top front of each module. The flow rate of the water may also be shown. Beneath the temperature display is the graphical interface 109. Interface 109 is a color LED display that visually displays the temperature of the water passing through the particular module. The solenoids use the data to display different colors representing the water temperature. User interface 111 is configured to provide a user control of module 103 and adjust settings. This may include a plus and minus button placed under the display to precisely control the temperature and/or flow rate of the water.

As also seen in FIG. 1 is a portable electronic device 113, such as a cell phone or electronic tablet for example. It is understood that device 113 may also be a desktop computer in some embodiments. Device 113 includes software that communicates with control module 103 and allows a user remote access and control of the various functions of system 101. System 101 incorporates Bluetooth communications technology that will allow the user to control the entire system via a smartphone or tablet device utilizing a software application.

Referring now to FIG. 3 in the drawings, system 101 is shown using a single control module 103. In FIG. 1, two control modules are utilized. System 101 is operative with either a single or plural number of modules 103. One or more sensors 105 may be used. Multiple sensors may permit an average temperature reading of the water, for example, as opposed to a localized spot.

The current application has many advantages over the prior art. System 101 is a digitally operated filling and temperature control device for home bathtubs and vessels. It monitors water temperature via a thermocouple installed in the interior of the sensing element 105. The thermocouple transmits water temperature data and receives adjustment instructions via user presets which may be set via communication with device 113 or through any interface.

Components of system 101 are produced of high-quality polymers and suitable for injection molding. When used as a dual control system, the system solenoids communicate together to control water flow and temperature. System 101 also monitors water level and automatically lowers or stops flow according to user presets, with safety features to prevent overflows.

Many materials may be used in construction of system 101. An aluminum outer casing is foreseeable as press formed and installed over the outer diameter of the modules and secured in place with industrial adhesive. Electronic components are housed in the interior body of each smart fill device. Electronics are sealed within a watertight sealant to prevent shorts and water damage and increase overall safety. Power may be provided through batteries or other sources. Water level and Temperature data are transmitted through watertight wiring from the Smart Fill sensor to the control devices. All wiring and electrical components are sealed and waterproof.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A smart fill system for use with a hot water line and a cold water line, comprising:

a first module coupled to the hot water line, the first module including a first solenoid configured to regulate water flow through the first module;

a first display with the first module;

a second module coupled to the cold water line, the second module including a second solenoid configured to regulate water flow through the second module;

a second display with the second module; and a sensor in electrical communication with the first and second modules, the sensor including a sensor wire for the transmission of data to and from the sensor, the sensor configured to detect the combined temperature of the water released from the first module and the second module, the sensor configured to detect the water level;

wherein the data includes both water level and water temperature.

2. The system of claim 1, wherein the first display shows the temperature reading of the water through the first solenoid.

3. The system of claim 1, wherein the first display shows the flow rate of water passing through the first module.

4. The system of claim 1, wherein the first display includes a graphical interface configured to display a color that is representative of the temperature of the water passing through the first module.

5. The system of claim 1, wherein the first display includes a user control configured to allow a user to adjust settings of the first module.

6. The system of claim 1, wherein the first module and the second module communicate wirelessly.

7. The system of claim 1, wherein the first module sends command data to the second module to regulate water flow in the second module to affect the relative temperature of the water dispersed through both modules.

8. The system of claim 1, wherein the sensor transmits fill level data to the first module.

9. The system of claim 8, wherein the first module is configured to shut off the water flow through both modules at a predetermined fill depth.

10. The system of claim 8, wherein the first module is programmed with a maximum fill depth to prevent over filling.

11. The system of claim 1, further comprising:

a remote electronic device in wireless communication with the first module, the remote electronic device permits wireless control over the first and second modules.

* * * * *